United States Patent [19]

Sala et al.

[11] Patent Number: 4,919,571

[45] Date of Patent: Apr. 24, 1990

[54] ORIENTATABLE BLOCKING UNIT WITH CARDAN JOINT FOR SUPPORTING STRUCTURES ON CYLINDRICAL ELEMENTS

[75] Inventors: Oneglio Sala; Paolo Montanari, both of Bologna, Italy

[73] Assignee: Riva Calzoni S.P.A., Milan, Italy

[21] Appl. No.: 252,070

[22] Filed: Sep. 29, 1988

[30] Foreign Application Priority Data

Oct. 5, 1987 [IT] Italy ..... 22145 A/87

[51] Int. Cl.[5] ..... E02B 17/08

[52] U.S. Cl. ..... 405/199; 405/196

[58] Field of Search ..... 405/195, 196, 199, 198; 254/29 A, 30, 93 R, 105

[56] References Cited

U.S. PATENT DOCUMENTS

| | | | |
|---|---|---|---|
| 2,944,403 | 7/1960 | Smith | 405/199 |
| 2,970,445 | 2/1961 | Suderow | 405/199 |
| 3,685,801 | 8/1972 | Ahlgren et al. | 254/105 |
| 4,041,711 | 8/1977 | Lucas | 405/199 X |

*Primary Examiner*—Dennis L. Taylor

*Assistant Examiner*—Arlen L. Olsen

*Attorney, Agent, or Firm*—Herbert Dubno

[57] ABSTRACT

The orientatable blocking unit for the support of structures on cylindrical elements is composed of a lower annular body, secured to the structure, in which the lower body there is present an upper annular body, coaxial with it in at-rest conditions, secured to an intermediate annular body by means of a pair of aligned, radial pins, which intermediate body is, in turn, secured to the lower annular body by means of a second pair of aligned, radial pins, perpendicular to the first pair. This permits, in operating conditions, the free orientation of the axis of the upper body with respect to that of the lower body. The upper body possesses an internal surface on which there are present a plurality of upwardly converging slide seats, in which there are slidably supported movable jaws, equipped internally with members for coupling by friction to a tubular column. Elastic members effect translatory movement of the jaws from a lowered, unblocking position to a raised, blocking position, radially gripping the column. The jaws can be retained in the unblocking position.

9 Claims, 6 Drawing Sheets

ORIENTATABLE BLOCKING UNIT WITH CARDAN JOINT FOR SUPPORTING STRUCTURES ON CYLINDRICAL ELEMENTS

FIELD OF THE INVENTION

The present invention relates to an orientatable blocking unit for the support of structures on cylindrical elements, especially for securing petroleum platforms in the open sea to the associated foundation columns or piles.

BACKGROUND OF THE INVENTION

For the securing of structures to cylindrical support elements, such as tubular foundation piles and the like, wedge devices are known, in which the load due to the weight of the structure produces on the wedges radial gripping forces permanently blocking the structure by friction onto the cylindrical element. An example of such an application is provided by the basement structures or decks of platforms for petroleum installations, which must be secured to the associated legs or foundation piles which provide their support.

Such basement structures or bridges, or other constructions for which such types of blocking devices are required are, in general, referred to below, in the interests of brevity, by the term "structures".

The known blocking devices have the characteristic of being rigid. Therefore, it is not possible, if necessary, to orientate the structure relative to the axis of the pile or column, for example in the case where the pile itself is not perfectly vertical, or where it may be necessary to arrange the structure or a part of it obliquely.

The known blocking devices, furthermore, are not easy to block and unblock, for example in the case where a modification of the position of the structure itself is required.

This renders assembly difficult in many cases, since it is often not possible to correct the position of the structure once it has been blocked on the pile. For orientation when it is possible, a lifting means for the structure, of the type used for positioning it, is required. The need for such a lifting means presents problems and incurs expense, especially in marine installations.

The inaccurate positioning of the structure on the piles, both with respect to elevation and with respect to the angle between the plane of the structure at the blocking point and the axis of the pile, is especially disadvantageous on account of the additional loads applied by it to the assembly. The correction of such inaccuracies during assembly is expensive and time-consuming.

OBJECTS OF THE INVENTION

It is the object of the invention to provide a blocking device for attaching a structure onto cylindrical support elements, such as tubular foundation piles, which can support high loads, can locate the structure accurately in the blocking position, can enable angular displacement and which furthermore permits limited misalignment between the pile and the blocking device for the structure.

SUMMARY OF THE INVENTION

These results are achieved by the present invention, which provides an orientatable blocking unit for supporting a structure on a cylindrical element, which unit is composed of a lower annular body, secured to the structure, in which lower annular body there is present an upper annular body, coaxial with it in an at-rest condition, secured to an intermediate annular body by means of a pair of aligned radial pins. The intermediate body, in turn, is secured to the lower annular body by means of a second pair of aligned radial pins, having their axes perpendicular to and coplanar with the first pair. It is possible, in an operating condition, freely to orientate the axis of the upper body with respect to the axis of the lower body, which upper body possesses and internal surface, on which there are present a plurality of equally spaced slide seats, converging upwards along the generatrices of a conical surface, on which there are slidably supported corresponding wedge jaws, there jaws being movable parallel to the generatrices of the conical surface and internally equipped with devices for coupling by friction to the cylindrical pile on post. Elastic means is present for translatory movement of the jaws from a lower unblocking position to a raised blocking position, in which the jaws radially grip the pile. There is also provided means for retaining the jaws in the lower, unblocking position.

Between the lower annular body, the upper annular body and the intermediate annular body, we can provide elastic connecting means for keeping the axis of the upper body in a coaxial position to the axis of the lower body in at-rest conditions. The connecting means is capable of deforming under operating conditions, thus permitting the orientation of the upper body with respect to its surroundings.

The elastic connection means interposed between the lower annular body and the upper annular body are composed of a plurality of elastic elements with vertical axes, uniformly spaced around the circumference of mutually facing surfaces of the upper and lower annular elements, and of a plurality of elastic elements with horizontal axes, uniformly spaced around the circumference of mutually facing surfaces of the upper and intermediate annular elements.

The pins for securing the intermediate annular element to the upper annular element and to the lower annular element are axially slidable in the associated seats, thus permitting a misalignment between the upper and lower annular elements.

The means for retaining the jaws in the unblocked position are composed, for each jaw, of a latch slidable with its axis substantially radial in the upper annular body, this latch being equipped with an elastic axial thrust element thrusting it into the sliding seat of the jaw, in a position where it interferes with the forward motion of the jaw itself when the latter is in the unblocked position. Controllable actuating means act in opposition to the elastic element of the latch, these means being adapted for moving the elastic element of the latch axially into a position where it does not interfere with the motion of the jaw under the action of the associated elastic device.

In the blocking unit according to this invention there may be present controllable actuators acting in opposition to the elastic devices of the jaws. The actuators bring the jaws into the unblocked position in the case where movements may be envisaged subsequent to the initial blocking.

In one preferred embodiment, the elastic means for the jaws are composed of preloaded helical springs and the controllable actuators adapted for bringing the jaws into the unblocking position are constituted by hydraulic jacks, arranged coaxially and inside the helical springs.

In the blocking unit according to this invention, there are present suspension means for suspension from an external support and axial translation equipment. The suspension means comprises actuators for disengaging from the external equipment, capable of being actuated after the unit has been blocked by means of the jaws.

In particular, the suspension means are composed of a suspension ring, secured to the upper annular element with the interposition of a plurality of jacks having vertical axes for moving the suspension ring axially into a position remote from the attachment devices of the external support and axial translation equipment.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
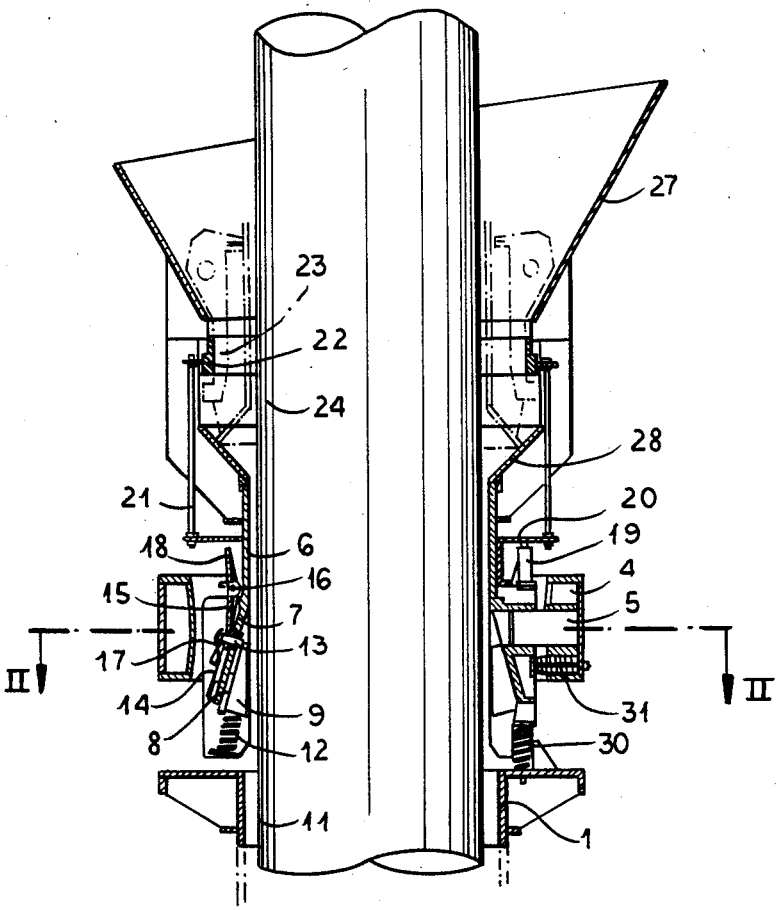
FIG. 1 is an axial section through the unit according to this invention, fitted onto a tubular pile, the section being taken along the line I—I of FIG. 2.
Figure 3:
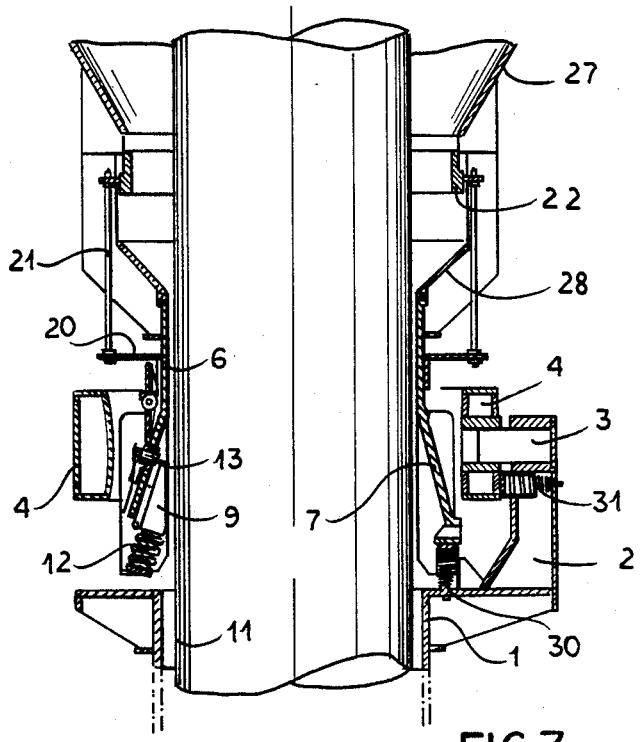
FIG. 3 is a section taken along line III—III of FIG. 2.
Figure 2:
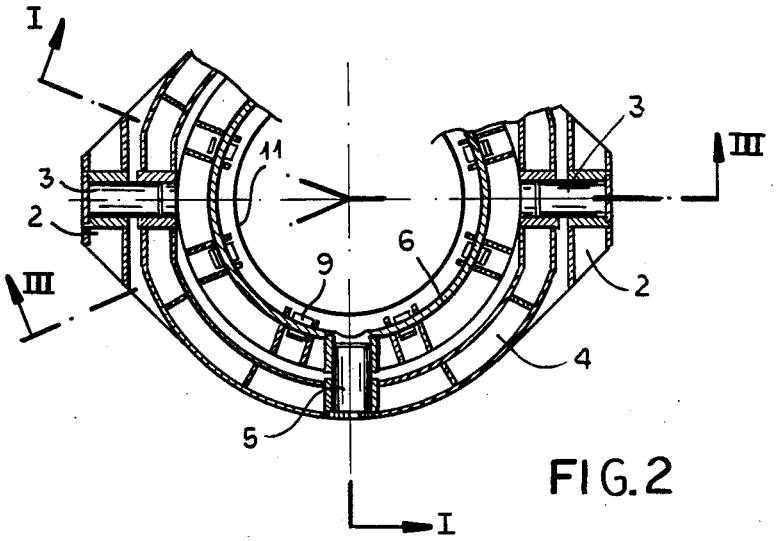
FIG. 2 is a section taken along the line II—II of FIG. 1.

As FIGS. 1, 2 and 3 show, the blocking unit according to this invention is composed of a lower annular body 1, rigidly connected to the structure, not shown, to be fixed onto the pile 11. To this lower annular body 1 and intermediate annular body 4 is connected by means of a pair of supports 2 (FIG. 3) and associated aligned pins 3 (FIGS. 2 and 3), having horizontal axes and symmetrically disposed about the axis of the body 1.

To the intermediate body 4 an upper annular body 6 is connected by means of a pair of associated aligned and opposed pins 5 (FIGS. 1 and 2), having their axes coplanar with and perpendicular to the axes of the pins 3. The upper annular body 6 possesses a conical lower part 7 diverging downwards and carrying upwardly converging slide guides 8, into which there are engaged respective wedge jaws 9, equipped with surfaces 10 adapted for coupling by friction onto the tubular pile 11.

The jaws 9 can be moved along the associated guides 8 by means of respective elastic devices 12, secured at the end to the lower edge of the part 7 of the annular body 6. The elastic devices 12 thrust the jaws 9 upwardly, from a lower position of larger diameter, in which the jaw 9 is spaced away from the pile 11 and the unit is in unblocked conditions, to a raised position of smaller diameter, in which the jaws grip around the pile itself, the unit then being in the position of blocking onto the pile.

In the gripping position of the jaws 9, under the action of the elastic devices 12, these jaws produce a radial compression of the pile 11, generating friction against the surface of said pile 4, so as to cause blocking (anchoring) of the structure onto the pile. The weight of the structure connected to the annular body 1 is also transmitted, through the inclined slide surfaces of the jaws 9, to the conical portion 7, in a direction radial to the jaws 9, thereby increasing the gripping force.

In correspondence with each of the jaws 9 there is also present a latch 13, slidable transversely to the surface of the part 7 of the upper annular body 6 disposed along the path of sliding of the jaw under the section of the associated elastic means 12. The latch 13 is equipped with an associated strip spring 14 (FIG. 5), acting against its outer end and adapted for pushing the latch into a position where it projects inside the conical part 7, to interfere with the forward (upward) movement of the jaw 9 under the action of the elastic element 12 so as to retain the jaw in the unblocked position.

Figure 4:
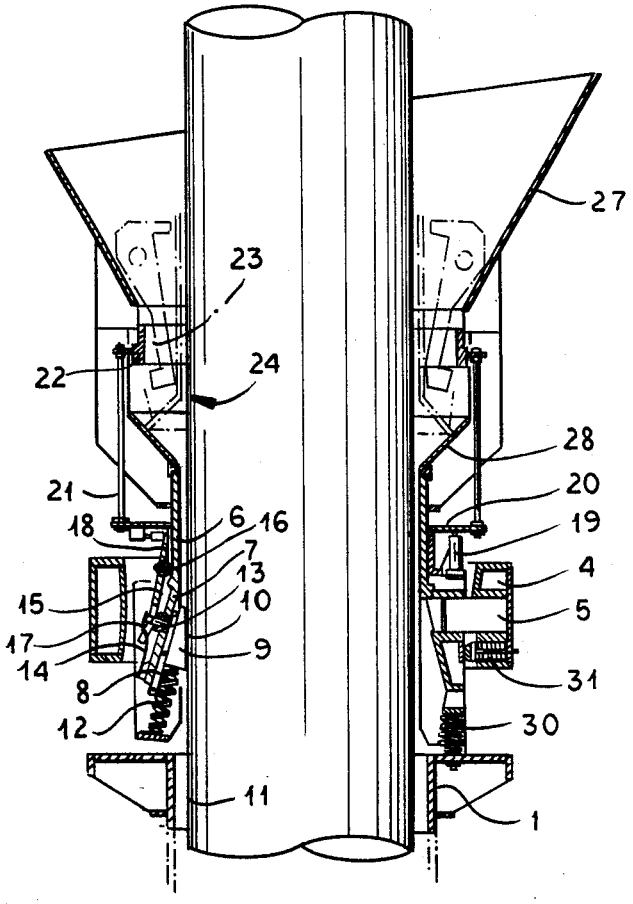
FIG. 4 is a view similar to FIG. 1 showing the blocking unit in the position of blocking onto the pile.
Figure 5:
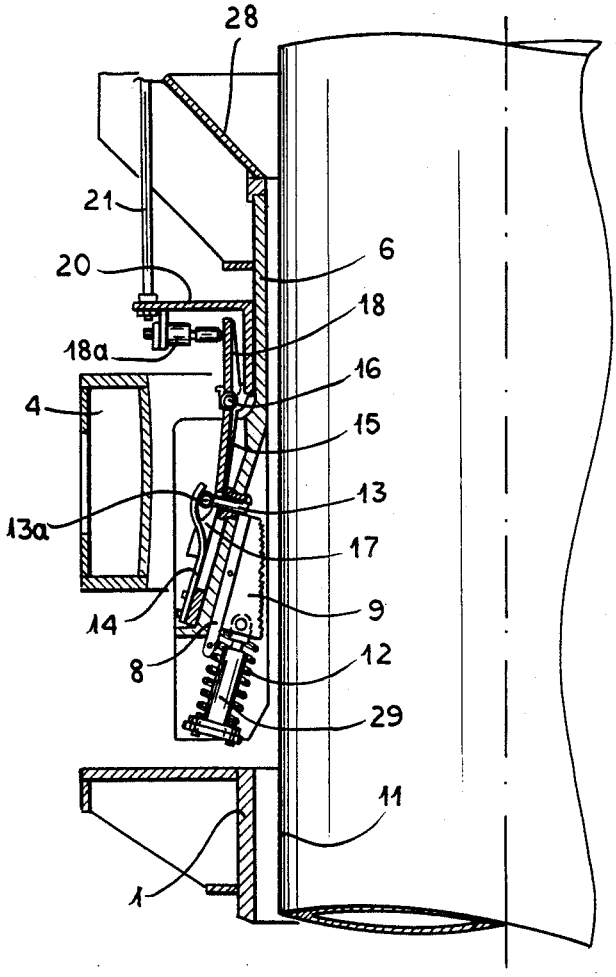
FIG. 5 is a detailed view drawn to an enlarged scale of the jaws, in the lowered position.
Figure 6:
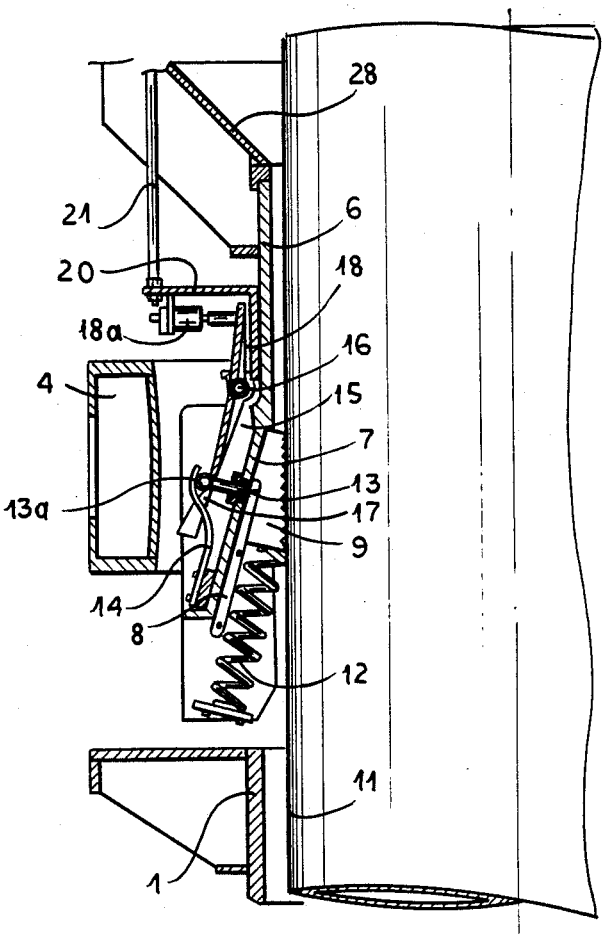
FIG. 6 is a view of the detail of FIG. 5 with the jaws in the position for blocking onto the pile.

The latch 13, as is shown in FIG. 5, is also equipped with a lever 15, pivotal about a pin 16 and acting with its lower forked end 17 on the outer end 13*a* of the latch 13 in opposition to the spring 14, which lever 15 possesses an upper end 18 for actuation, associated with a relative actuator 18*a* having its axis radial. As FIGS. 4 and 6 show, an action in the radial direction on the end 18 of the layer 15 causes the lever to rotate about its pin 16 and the latch 13 to be retracted, thereby freeing the movement path of the jaw 9, which can then be pushed by the elastic element 12 into the blocking position.

The upper annular body 6 is equipped, furthermore, with a plurality of jacks 19 (FIG. 1), with vertical axes, the movable rod of which is connected to an annular plate 20, connected in turn by a plurality of bars 21 to a suspension ring 22.

Figure 7:
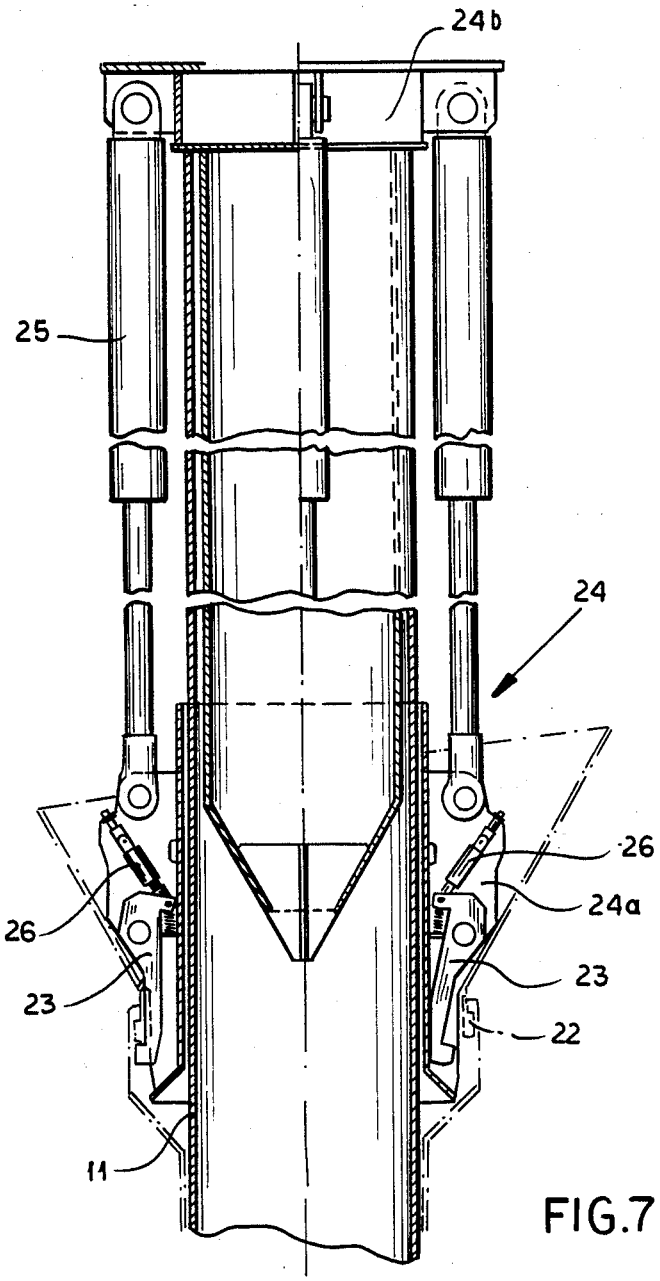
FIG. 7 is a sectional view showing the suspension equipment in elevation.

To this suspension ring 22 there may be attached the movable coupler ends 23, pivotal about the associated pins 23*a*, of a lifting apparatus 24 shown in dot-and-dash lines in FIG. 1 and more clearly illustrated in FIG. 7, this equipment being equipped with associated jacks 25, by means of which the lower part 24*a* of the equipment 24, carrying the coupler ends 23, is connected to the upper part 24*b*, resting upon the upper end of the pile 11, by means of which apparatus the entire blocking unit, and the structure secured to it, can be suspended from the pile 11 and can be displaced axially to be brought into the desired location along the pile.

In this phase, the jaws 9 are kept in the lowered position or unblocked position, by the latches 13, and the elastic means 12 remain in the preloaded state.

When the correct location level has been found along the pile, the jaws are released by retracting the latches 13 and come into the blocking position under the action of the elastic means 12. For the purpose of transferring the weight of the unit and of the structure secured to it onto the jaws themselves, the jacks 19 raise the annular plate 20 and the suspension ring 22, moving the ring out of engagement with the coupler ends 23, which can therefore be brought into the open position by the associated actuators 26, as shown in FIG. 7 in the right-hand portion, thus allowing the lifting equipment 24 to be disengaged and moved away.

For the purpose of making possible easy introduction of the pile 11, to enable it to be driven inside the blocking unit, the upper annular body 6 is equipped with entrance funnels or tapered aprons 27 and 28, of which the funnel 28 also fulfills the function of supporting and centering the lifting equipment 24.

To enable the blocking unit to be disengaged from the pile on future occasions, for example for the purpose of carrying out adjustment operations to the fixing elevation, or for correcting possible settlement or the like, there are provided, coaxially to the elastic elements 12, which can be helical springs, unblocking or disengaging jacks 29, shown in FIG. 5, by means of which it is possible to bring the jaws back into the lowered position in opposition to the springs 12, so as to make possible unblocking and axial movement of the unit on the pile.

The jacks 29 may be omitted in the case where a displacement of the structure on the pile after the initial fixing is not envisaged.

The upper annular body 6 is also secured to the lower annular body 1 by means of a plurality of elastic elements 30 (FIG. 1) having vertical axes, appropriately constituted of helical springs as shown and equally spaced around the circumference of the body 6, and other elastic elements 31, having radial axes and also conveniently composed of helical springs, are interposed between the body 6 and the intermediate annular body 4. These elastic elements as a whole are adapted to keep the upper body 6 and the intermediate annular body 4, in the at-rest conditions, in a coaxial and aligned position with the lower annular body 1, without however obstructing movement.

The structure of the blocking unit according to this invention therefore permits the structure connected by it to the pile to adjust its orientation angularly into the correct position, as a result of the cardan joint unit composed of the intermediate annular body 4 with the associated securing pins 3, 5 respectively for securing it to the lower annular body 1 and upper annular body 6, these pins having mutually perpendicular axes in the horizontal plane and being coplanar with one another. The unit itself may, furthermore, compensate any errors in coaxiality that may occur of the pile with respect to the axis of the unit, as a result of the axial sliding of the pins 3, 5 in the respective seats of the intermediate annular body 4, as a result of the radial play for this purpose provided between the upper body and the intermediate body and between the intermediate body and the lower body.

In this manner, the entire unit is disposed, at the instant when the pile is positioned, in a defined position which is convenient for the initial mounting. Afterward, its deformability allows it to follow the angular movements of the upper body 6 in the lower body 1, in order to achieve the desired position or orientation.

The unit according to this invention therefore allows, in an effective manner, blocking of a structure onto cylindrical elements and the like, as in the case of decks and platforms for petroleum extraction units in the open sea, in a manner permitting orientation and unblocking.

Although the present invention has been described in detail by reference to a structure to be secured to a tubular pile, it is also applicable to every other case in which mutual attachment, permitting orientation and later unblocking, between a lower element and a cylindrical body is desired.

We claim:

1. An orientatable blocking unit for securing a structure on a cylindrical post, comprising:

a lower annular body surrounding said post with play and carrying said structure;

an intermediate annular body surrounding said post with all-around clearance;

an upper annular body surrounding said post with play and having a portion interposed between said post and said intermediate body;

a first pair of axially aligned pins articulatingly connecting said lower annular body to said intermediate annular body;

a second pair of axially aligned pins extending perpendicular to but coplanar with said first pair of pins articulatingly connecting said upper annular body at said portion to said intermediate annular body;

means on said portion of said upper annular body defining a plurality of upwardly converging slide seats angularly equispaced around said post and having respective cone generatrices;

respective upwardly tapering wedge-shaped jaws having inwardly turned frictional surfaces confronting said post and frictionally engageable therewith upon an upward movement of said jaws relative to the respective seats, said jaws being slidable on the respective seats along said generatrices;

respective elastic means bearing upon said jaws and urging same upwardly along the respective seats from a lower unblocking position into an upper blocking position in which said jaws fix said unit to said post;

detent means engageable with said jaws for releasably retaining same in said lower positions; and elastic connection means interposed between said lower annular body and said upper annular body and between said intermediate annular body and said upper annular body for yieldably urging said body into axial alignment and enabling angular orientation of said upper body relative to said lower body.

2. The orientatable blocking unit defined in claim 1 wherein said elastic connection means includes a plurality of elastic elements having vertical axes interposed between said upper body and said lower body and angular equispaced around said post, and a plurality of elastic elements having horizontal axes and braced between said intermediate body and said upper body and angularly equispaced about said post.

3. The orientatable blocking unit defined in claim 1 wherein said pins are axially slidable relative to the respective bodies to enable misalignment of said upper and lower bodies.

4. The orientatable blocking unit defined in claim 1 wherein said detent means includes a latch shiftable generally radially in the respective seat and engageable with an upper end of the respective jaw, an elastic element acting on said latch for displacing it into a path of said jaw and a controllable actuator adapted to act on each latch counter to the direction upon which the respective elastic element acts thereon to displace the respective latch out of the respective path.

5. The orientatable blocking unit defined in claim 1, further comprising means operatively connected with said jaws for drawing said jaws from the respective upper position into the respective lower position.

6. The orientatable blocking unit defined in claim 1 wherein said elastic means includes a respective prestressed helical spring acting upon each of said jaws.

7. The orientatable blocking unit defined in claim 1, further comprising a hydraulic jack within each of said springs connected to respective jaw and actuatable for drawing each jaw from its respective upper position to its respective lower position.

8. The orientatable blocking unit defined in claim 1, further comprising suspension means connectable with said upper body for supporting said unit on said post and provided with actuators for disengaging said suspension means upon blocking of said unit on said post by said jaws.

9. The orientatable blocking unit defined in claim 8 wherein said suspension means include a suspension ring connected to said upper body by a plurality of vertical jacks for axially shifting said suspension means.

* * * * *